US005449178A

United States Patent [19]

Castronova

[11] Patent Number: 5,449,178

[45] Date of Patent: Sep. 12, 1995

[54] CHESS GAME

[76] Inventor: Michael J. Castronova, 3491 Dowling Rd., Delton, Mich. 49046

[21] Appl. No.: 278,018

[22] Filed: Jul. 20, 1994

[51] Int. Cl.[6] ..... A63F 3/02

[52] U.S. Cl. ..... 273/260

[58] Field of Search ..... 273/260, 261

[56] References Cited

U.S. PATENT DOCUMENTS

| | | | |
|---|---|---|---|
| 3,672,680 | 6/1972 | Grey | 273/260 |
| 4,249,740 | 2/1981 | Cheney et al. | 273/260 |
| 5,257,787 | 11/1993 | Miccio | 273/260 |

FOREIGN PATENT DOCUMENTS

| | | | |
|---|---|---|---|
| 2201351 | 9/1988 | United Kingdom | 273/260 |
| 1703150 | 1/1992 | U.S.S.R. | 273/260 |

*Primary Examiner*—William E. Stoll

*Attorney, Agent, or Firm*—Varnum, Riddering, Schmidt & Howlett

[57] ABSTRACT

An improved game of chess is disclosed in which capture as a strategy is weakened and major pieces are subsequently kept on the board to enhance strategic play. Captured major pieces are replaced with pawns, the game starts with each player having only four pawns on the board, each player is limited to one pawn per file, and pawns promote at the fifth rank, but only from captured major pieces. A protected pawn cannot be captured by a major piece. A chess board is disclosed for enhancing playability of the game. The board is divided into two halves representing the player's representative sides of the board, by a colored dividing line and differently colored light squares representing the two halves. In the initial setup, each player has pawns on Rook 4, Queen 4 and King 3, and these squares are marked on the board to facilitate correct initial positioning of the pawns.

12 Claims, 1 Drawing Sheet

CHESS GAME

BACKGROUND OF THE INVENTION

1. Field of the Invention

The invention relates to an improved version of the standard game of chess.

2. State of the Prior Art

The game of chess has a long and proud history. By many accounts it originated in the ranks of royalty during the early middle ages. However, some believe it may have actually derived from a game played several thousand years before the birth of Christ. In any event, the standard game of chess is well known to many aficionados around the world. The World Chess Federation regulates tournaments and publishes a set of rules by which tournament play is regulated.

Chess is a game of strategy and intellect. Successful play requires a knowledge of strategy and an ability to plan and foresee an opponent's strategy as a game develops. This attribute of a standard chess game produces a game of high intellectual satisfaction.

The standard game of chess is not without its drawbacks, however. The original game of chess, as played several hundred years ago, did not encompass plays such as promoting the rank of pawns, capturing en passant and castling. These features were added over time to limit the number of games ending in a draw. Even with these modifications to the original game of chess, checkmate often cannot be achieved due to ineffective play resulting in a total depletion of forces capable of attaining the goal of checkmate.

A typical game of chess starts with one of several standard openings designed to quickly establish positions of power on the chess board. The game quickly transitions into a middle game in which the object is to reduce the opponent's forces while continuing to establish positions of power upon the board. The end game typically involves one of the players gaining a more powerful position and more remaining forces to chase the opponent's king into checkmate. With evenly matched experienced players, games often end in a draw with neither player having sufficient forces remaining to force their opponent's king into checkmate.

SUMMARY OF THE INVENTION

A method for playing a game of chess according to the present invention incorporates the essential characteristics of standard chess, including the original ingenious way of moving the pieces and the object of the game to check mate an opponent, while enhancing strategies of play directed toward capturing the King and reducing strategies of play directed to reducing opponent's forces. With a tendency toward a greater number of pieces on the board, the game according to the present invention provides greater complexities in offensive and defensive tactics while nearly eliminating the possibility that a game can end in a draw.

According to the invention, a method for playing a game of chess between a first player and a second player uses pieces comprising pawns and major pieces wherein the major pieces comprise kings, queens, rooks, bishops, and knights, with the first player's pieces being of a first color and the second player's pieces being of a second color. The game is played on a board comprising a matrix of squares arranged into ranks and files and the steps include each of the first and second players moving a piece in turn with each move comprising the relocation of one of the player's pieces from one square to another square on the board. An improvement comprises the step, at the option of the second player, of placing an additional pawn of a second color onto an unoccupied square selected by the second player in the second player's second, third or fourth rank and in a file which contains no other pawn of the second color upon the capture of one of the second player's major pieces by one of the major pieces of the first player.

Preferably, the method according to the invention further comprises the step of the second player selectively moving one of the pieces of the second color in the same turn, immediately after the step of placing the additional pawn. Preferably, the method comprises the step of commencing the game with no more than four pawns of the first color and four pawns of the second color on the board. Preferably, pawns of the first color are placed on the Rook 4, Queen 4, and King 3 squares of the first player and pawns of the second color are placed on the Rook 4, Queen 4, and King 3 squares of the second player. Further, pawns selectively move one or two squares in sideways direction or one square forward, with an option from the second rank only to advance two squares forward. The maximum number of pawns of either color on the board at any one time is eight.

Preferably, the method further comprises, replacing, at the option of the moving player, a pawn with a previously captured major piece of the same color, if any, when the pawn is moved to the fifth rank of the moving player without capturing a pawn in the same move.

Further, the method comprises a step of creating a protected pawn, protected by capture by major pieces of the opposite color. The protected pawn is created by positioning a protector piece of the same color as the protected pawn on a first square and positioning the protected pawn on a second square with the protector piece in position to move to the second square in a single move without placing the King of the same color as the protected pawn into check.

After moving a first color pawn to a square in the first player's eighth rank and prior to the second player making a move, the method further comprises the step of the first player moving the pawn from the eighth rank square to an unoccupied square in the first players's second rank and in a file not occupied by another first color pawn. After making a move to create a first arrangement of pieces on the board, it is not a legal move for a player to later make the same move to create the same arrangement of pieces on the board, whereby repetitious cycles of moves are eliminated from the game.

Preferably, the Rook 4, Queen 4, and King 3 squares of each player are marked for a correct initial placement of the pawns upon the board. The board can be divided into a first and second half between the fourth and fifth rank, with light squares in the first half being of a different color from light squares in the second half.

A game assembly according to the invention comprises two sets of differently colored movable pieces. Each set of pieces includes pawns and major pieces, the major pieces comprising kings, queens, bishops, knights, and rooks. A board is provided having a matrix of squares arranged into ranks and files. A set of instructions is provided for playing the game wherein the instructions include the steps of a method for playing a game of chess between a first player and a second player. The steps include each of the first and second players moving a piece in turn, each move comprising the relocation of one of the player's pieces from one square to another square on the board. Also, the instructions include the step of, at the option of the second player, placing an additional pawn of a second color onto an unoccupied square selected by the second player in the second player's second, third, or fourth rank and in a file which contains no other pawns of the second color upon the capture of one of the second player's major pieces by one of the major pieces of the first player.

BRIEF DESCRIPTION OF THE DRAWINGS

The invention will now be described with reference to the accompanying drawing in which.

DETAILED DESCRIPTION

Figure 1:
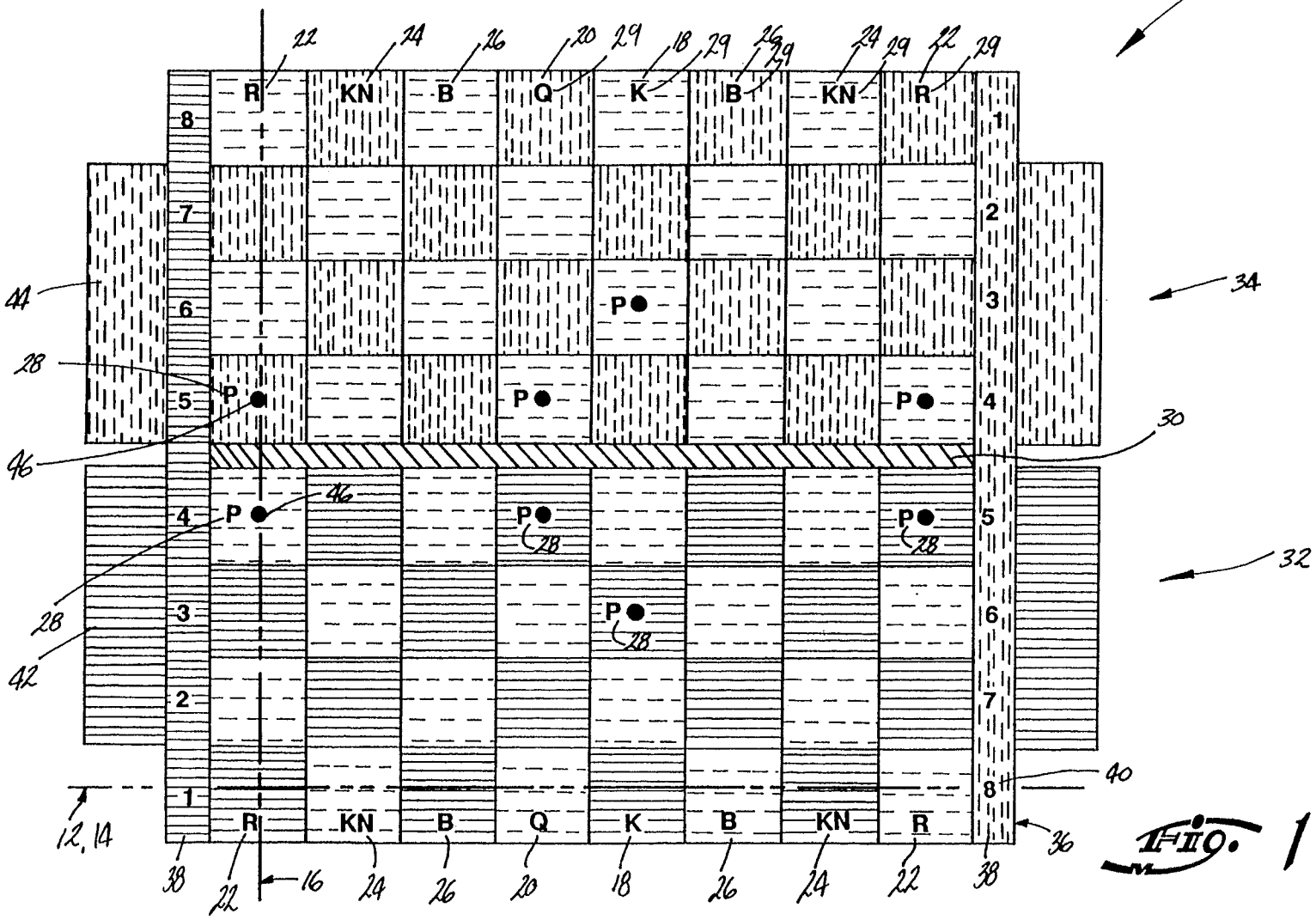
FIG. 1 illustrates a plan view of a chess board according to the invention and illustrates the starting arrangement of pieces.

The game according to the present invention incorporates the basic rules of standard chess with modifications as described herein. It employs standard chess pieces and can be played on a standard chessboard comprising a grid of 64 squares having eight squares along each edge with alternating light and dark colored squares. Preferably, the present game is played on a game board 10, as illustrated in FIG. 1, representing a modified version of a standard chessboard. On a chessboard, squares are often identified in terms of their rank and file. A rank 12 is a line of squares extending laterally across the board relative to the edge facing the player, with the player's first rank 14 being that rank closest to the player. Each rank 12 is identified numerically. A file 16 is a line of squares running perpendicular to a rank and extending from one edge facing a player toward the opposing edge on the other side of the board. A file 16 is identified by the name of a major piece in the first rank 14 at the start of the game. As in standard chess, a player's major pieces 29 include a King 18, a Queen 20, two Rooks 22, two Knights 24, and two Bishops 26. Thus, for example, the file 16 in which the King 18 is located is termed the King file or King's file. The file in which the rook 22 closest to the King 18 is located is termed the King's Rook file. Individual squares are identified in the same fashion. Thus, for example, the square located in a player's third rank 12 and in the King's Rook file is termed King's Rook 3.

Major pieces 29, including the King 18, the Queen 20, the Rooks 22, the Bishops 26, and the Knights 24, move in the same manner as in standard chess. However, castling is not permitted. Thus, the King 18 can move one square in any direction, forward, backward, sideways or diagonally. The Queen 20 can move an unlimited number of unobstructed squares in any direction. The Rooks 22 can move an unlimited number of unobstructed squares either forwards, backwards, or laterally. The Bishops 26 can move an unlimited number of unobstructed squares diagonally. The Knights 24 move in their traditional L-shaped pattern, that is one square forwards, backwards, or laterally followed by one square diagonally. As in standard chess, if the path of a King 18, Queen 20, Rook 22 or Bishop 26 is blocked by another piece the movement of the King, Queen, Rook or Bishop is thus limited. However, the movement of the Knight 24 is not so hindered.

According to the invention, Pawns 28 move in the same manner as in standard chess. However, Pawns 28 are also permitted to move one or two squares to either side at the player's option. Each file 16 may contain no more than one Pawn 28 for each player, except where a piece is captured by a Pawn 28. The capturing Pawn 28 may be moved into a file 16 occupied by another Pawn 28 of the same player. Additionally, Pawns 28 can capture en passant as in the standard game of chess.

FIG. 1 illustrates the opening arrangement of the players upon the board. The major pieces 29 are arranged as in the standard game of chess. Each player has either light or dark pieces, commonly termed white and black pieces. FIG. 1 illustrates the game board 10 from the viewpoint of the player having the white pieces. The white Queen 20 is placed upon the most centrally located white square in the first rank 14. The white King 18 is placed upon the most centrally located dark square in the first rank 14. The Bishops 26 are placed in the home rank 14 immediately adjacent the King and Queen 18 and 20. The Knights 24 are placed in the first rank 14 immediately adjacent the Bishops 26. Finally, the Rooks 22 are placed in the corner squares of the first rank 14 immediately adjacent the Knights 24.

Each player has only four Pawns 28 which are placed on the board as illustrated in FIG. 1. One Pawn 28 is placed in the third rank 12 in the King file 16, which position is otherwise termed King 3. A second Pawn 28 is placed at Queen 4 and the third and fourth Pawns are placed at Rook 4. The Queen and Rook files 16 can be considered power lanes and the Pawns 28 in these files 16 are placed in the fourth rank 12 to eliminate first move advantages for the Queen 20 and Rooks 22.

Whenever a major piece 29 is captured by an opponent's major piece, the player whose major piece was captured receives a sided Pawn 28 to be placed, at the player's discretion on an unoccupied square in that player's second, third or fourth rank 12 without doubling Pawns 28 in a file 16. Sided Pawns 28 are not received for capture of a major piece 29 by a Pawn 28. The sided Pawn 28 is placed immediately after the capture, and is not considered a move. Thus, the player receiving the sided Pawn 28 may immediately move the newly-received sided Pawn 28. Also, in the event the capture of a major piece 29 results in an apparent checkmate, the sided Pawn 28 is playable if it can be used to create a flight square or make a counter-capture that will negate the checkmate. If a major piece 29 captures an opponent's major piece 29 and a sided Pawn is placed on the board 10 to put the King 18 into check, of course, the newly-placed sided Pawn 28 cannot be moved to capture the King 18. However, another piece may be moved. If a player has all eight Pawns 28 on the board, then no additional sided Pawns 28 can be obtained even upon capture of a major piece 29. Also, in the event that a major piece 29 is captured and there are no legitimate squares for placement of a sided Pawn 28, no Pawns 28 can be received. A sided Pawn 28 can be declined.

Pawns 28 can be promoted upon being moved to a player's fifth rank 12. However, Pawns 28 can only be promoted from a captured major piece 29. Therefore, a player can never have more than one Queen 20, two Rooks 22, two Bishops 26 or two Knights 24 on the board 10 at any one time. A Pawn 28 can capture a major piece 29 on a fifth rank 12 and promote, but a sided Pawn 28 cannot be received via the promotion. A Pawn 28 can capture an opponent's Pawn 28 on a fifth rank but cannot be promoted. Pawns 28 do not have to be promoted when advanced to, or by capturing a major piece 29 to, a fifth rank 12. A Bishop 26 cannot be promoted to the same color square as the same player's other Bishop 26. A player can place his or her Pawn 28 on the fourth rank 12, then advance to or capture a major piece in the fifth rank and then promote. Pawns cannot jump other pieces, but can capture en passant.

To enhance the strength of each player's position on the board, protected Pawns 28 cannot be captured by a major piece 29. A protected Pawn 28 is a Pawn 28 on the controlling square of any piece, Pawn or major, i.e., a square which can be attacked by an opponent's piece. An unprotected Pawn 28 can be stolen, meaning the major piece 29 stealing the Pawn 28 cannot be recaptured in any way by the opposing player's next move. Pawns 28, however, can capture other Pawns 28 regardless of any protection. The King 18 alone cannot protect a Pawn 28 from two or more attacking majors 29. A piece which is pinned on the King 18 cannot protect a Pawn 28. A major piece 29 which is moved in a discover check or a double check may steal a Pawn 28 regardless of any protection if the capturing major cannot be recaptured by the King 18.

In standard chess, captures of protected Pawns 28 are a major type of play in which forces of both players are reduced. Typically, a player captures a Pawn 28 with a major piece 29, the opponent captures the major piece 29 with another major piece 29 and the first player captures the capturing major piece 29 of the opponent. In all, two major pieces 29 and a Pawn 28 are removed from play. By preventing captures of protected Pawns 28 by major pieces 29, these force reducing exchanges are eliminated and major pieces 29 are kept on the board 10 for more strategic play.

The rules of the present game greatly enhances the complexity of the game and its playing strategies by encouraging players to retain pieces on the board. The resulting game has few captures and is thus significantly different than standard chess. Not only is there more power on the board but the complexity of the game is greatly enhanced over standard chess. For instance, the illustrated set-up eliminates a first move check with the Queen 20 at King's Rook 5. The position also removes the centerline Pawn 28 positioning factor which supports the major piece development theme. The set-up and also eliminates a first move Pawn 28 exchange at Queen 4 which is contrary to the goal of the present game to retain as much power on the board throughout the course of the game as possible. The King 3 Pawn eliminates an effective first move Bishop check at Queen Knight 5. If the first player were to make this move, the second player would be able to counter by blocking with the Knight 24 at the Queen's Bishop 3 square. While the Knight 24 would appear unprotected and susceptible to capture by the first player's Bishop 26, its capture would result in a sided pawn being given to the second player who would then be able to place the sided pawn and capture the Bishop 26. The captured Bishop 26 of course would not be replaced by a sided Pawn 28, leaving the first player who initiated the exchange worse off, and leaving the second player with an additional Pawn 28 for possible promotion back to a Knight 24. Thus, the first player is discouraged from making this senseless exchange. It also protects the Queen Pawn 28 and serves as an effective defensive Pawn 28 on the third rank 12.

In the set-up illustrated, it is very difficult to advance one of the four initially set Pawns 28. This encourages players to develop their major pieces 29 foremost to create more complex and unpredictable opening moves and to allow for equal opportunity offense and defense. Having only four Pawns 28 at the start enables for an equal and significant number of open files 16 to accommodate effective placement of sided Pawns 28.

When a Pawn 28 reaches the eighth rank 12 it can be repositioned to any unoccupied square on the player's respective second rank 12 without placing more than one Pawn 28 into a single file 16. Pawns 28 can only be repositioned to the second rank 12. A Pawn 28 can capture to the eighth rank 12 and be repositioned to the second rank 12. If a legitimate square is not available for repositioning to the second rank 12, a Pawn cannot advance to or capture to the eighth rank 12.

In standard chess, games sometimes devolve into a repetitive loop of moves from which the players seem unable or unwilling to extricate themselves. In the present game, when a particular situation exists on the board, it is illegal to commit the same move that will recreate that exact same situation.

A King 18 cannot move onto or capture onto a square that will put the King 18 into check. This will not prevent a sided Pawn 28 from being placed to put a King 18 into check. A move is defined as being the specific beginning position of a piece to the specific end position. Therefore, neither the beginning nor the end position is the sole determining factor in whether a move is illegal.

The board 10 is provided with several additional features to enhance playability of the game according to the rules. Several of the rules of the game revolve around the fourth and fifth ranks 12, and thus it improves the playability of the game to clearly divide the board 10 between the fourth and fifth ranks 12. To this end, a differently colored dividing line 30 is provided between the fourth and fifth ranks 12 to divide the board 10 into a first half 32 and second half 34. The dividing line 30 is preferably a dark green color. The dark colored squares in the first half 32 are also preferably of a different but visually compatible color to the dark squares in the second half 34. The differently colored dark squares visually divides the board 10 and by making the squares visually compatible the light and dark square combination of the chess board 10 remains clear. Along each player's left lateral side 36 of the board 10, a stripe 38 of the same color as the dark colored squares on their half 32 or 34 of the board 10 is provided. Reference numerals 40 are provided to designate the number of each of that player's ranks 12. Lateral of the stripes 38, color coordinated spaces 42 and 44 are provided for storing captured majors 29 and sided Pawns 28 which are to be used throughout the course of the game. Of course, alternatively, the light colored squares could be made of compatible colors with the dark squares being black or another dark color. To avoid confusion at the initial set-up, tiny dots 46 are preferably placed on the squares upon which the Pawns 28 are to be initially set.

For illustrative purposes, a short game according to the present invention is illustrated along with comments. The notation generally follows standard chess movement notation familiar to those skilled in the art of chess and specifically comprises:

K=King,
Q=Queen,
R=Rook,
B=Bishop,

N=Knight, P1=Pawn.
(−)=move to,
(×)=capture,
(+)=check,
(/) indicates placement and move,
( . . . ) indicates a black move,
PP=Sided Pawn Placement,
re.=Repositioned Pawn,
( ) indicates promotion or specific piece.

| | White | Black |
|---|---|---|
| 1. | Q-B2, [strong position/diagonal] | P(Q)-KB4, [defending Q-N6+] |
| 2. | Q-KN2 | Q-N3, [for flight square] |
| 3. | Q-N6+ | K-Q1 |
| 4. | N-KB3 | B-N5+ |
| 5. | N-B3, [if . . . BxN, PP-QN2/PxB white gains a pawn] | N-QB3 |
| 6. | N-K5 | B-Q2 |
| 7. | Q-N7 | K-B2, [error, should have N-B3] |
| 8. | QxB+ | PP-QN2/K-N1 |
| 9. | QxP | N(1)-K2 |
| 10. | K-Q1, [freeing the N] | R-N1 |
| 11. | N-N5 | Q-Q1 |
| 12. | N-Q7+ | K-B1 |
| 13. | P-Q5 | Q-B1 |
| 14. | N-N6+, [NxQ+ is bad; . . . PP-Q2/PxQ] | K-N1 |
| 15. | P-Q6 | N-Q4 |
| 16. | P-Q7 | P-B2 |
| 17. | Q-K8+, [very complex; strong check, if . . . QxQ, PP-QB4/PxQ/re. Q2, N-? , P-BS(Q) and black looses the Q] | K-N2 |
| 18. | Q-B8+ | RxQ |
| 19. | PP-QB4/PxN(Q) | R-Q1 |
| 20. | QxN+, [forcing the K up] | PP-K4/KxQ |
| 21. | PP-QB3/PxB | Q-Q3+, [big error] |
| 22. | N-Q4+, [ff . . . PxN, P-N5(Q)+ trouble] | K-N2 |
| 23. | P-N5(Q) | P(2)xN |
| 24. | Q-R6+ | K-N1 |
| 25. | P-N7 | K-B2 |
| 26. | P-N8/re. Q2 | PxN(N) |
| 27. | Q-R7+ | K-B3, [. . . K-B1 is bad, B-R6 mate] |
| 28. | B-N5 + | K-Q4 |
| 29. | PxN | Q-K3 |
| 30. | Q-Q7+, [if . . . RxQ or QxQ, PP-K4/P-K5(Q) mate] | P-Q3 |
| 31. | Q-B6+ | KxP |
| 32. | B-N2 mate | |

While particular embodiments of the invention have been shown, it will be understood that the invention is not limited thereto since modification can be made by those skilled in the art, particularly in light of the foregoing teachings. Reasonable variation and modification are possible within the foregoing disclosure of the invention without departing from its true spirit and scope. It is to be understood that the description of the particular embodiment contained herein is by way of illustration and not limitation, and that the scope of the appending claim should be construed as broadly as the prior art will permit.

What is claimed is:

1. In a method for playing the game of chess between a first player and a second player using pieces comprising pawns and major pieces, wherein the major pieces comprise kings, queens, rooks, bishops, and knights, the first player's pieces being of a first color and the second player's pieces being of a second color, and further using a board comprising a matrix of squares arranged into ranks and files, wherein the steps include each of the first and second players moving a piece in turn, each move comprising the relocation of a single one of the player's pieces from one square to another square on the board, the improvement comprising:

the step, at the option of the second player, of placing an additional pawn of a second color onto an unoccupied square selected by the second player in the second player's second, third or fourth rank and in a file which contains no other pawn of the second color upon the capture of one of the second player's major pieces by one of the major pieces of the first player.

2. The method according to claim 1 and further comprising the step of the second player selectively moving one of the pieces of the second color, in the same turn, immediately after the step of placing the additional pawn.

3. The method according to claim 2 and further comprising the step of commencing the game with no more than four pawns of the first color and four pawns of the second color on the board.

4. The method according to claim 3 and further comprising the step of commencing the game with a pawn of the first color on each of the Rook 4, Queen 4 and King 3 squares of the first player and a pawn of the second color on each of the Rook 4, Queen 4 and King 3 squares of the second player.

5. The method according to claim 4 wherein the maximum number of pawns of either color on the board at any one time is eight.

6. The method according to claim 5 and further comprising the step of limiting the number of first color pawns to eight and limiting the number of second color pawns to eight.

7. The method according to claim 3 and further comprising the step of:

replacing, at the option of the moving player, a pawn with a previously captured major piece of the same color, if any, when the pawn is moved to the fifth rank of the moving player without capturing a pawn in the same move.

8. The method according to claim 3 and further comprising the step of the first player creating a protected pawn comprising one of the first color pawns which is thereby protected from capture by any of the second color majors, the creation of a protected pawn comprising the steps of:

positioning a protector piece, comprising one of the first color pieces on a first square; and positioning said protected pawn on a second square;

wherein said protector piece is positioned to move to the second square in a single move without placing the first king into check.

9. The method according to claim 3 and further comprising the steps of the first player moving a first color pawn to a square in the first player's eighth rank and prior to the second player making a move, the first player moving said pawn from said eighth rank square to an unoccupied square, the unoccupied square being in the first player's second rank and in a file not occupied by another first color pawn.

10. The method according to claim 3 wherein, after making a first move to create a first arrangement of pieces upon the board, it is not a legal move for the first player to later make the first move to create the first arrangement of pieces on the board, whereby repetitious cycles of moves are eliminated from the game.

11. The method according to claim 4 and further comprising the step of marking the position of the Rook 4, Queen 4 and King 3 squares of each player whereby correct initial placement of the Pawns upon the board is facilitated.

12. The method according to claim 3 and further comprising providing the board with alternating light and dark squares, dividing the board into a first half and second half between the fourth and fifth rank of each of the first and second players, and coloring the light squares in the first half differently from the light squares in the second half.

* * * * *